United States Patent [19]

McCall

[11] 4,223,821

[45] Sep. 23, 1980

[54] PRESS-FEED UNITS

[76] Inventor: Arthur A. McCall, 16-22, Market Pl., Warwick, England

[21] Appl. No.: 873,839

[22] Filed: Jan. 31, 1978

[51] Int. Cl.[2] ..... B65H 17/26

[52] U.S. Cl. ..... 226/101; 226/112; 226/150; 226/141; 226/162; 83/277

[58] Field of Search ..... 226/101, 108, 112, 115, 226/137, 139, 141, 147, 149, 150, 158, 159, 161, 162; 83/277

[56] References Cited

U.S. PATENT DOCUMENTS

| | | | |
|---|---|---|---|
| 2,929,626 | 3/1960 | Weymouth | 226/162 |
| 3,038,645 | 6/1962 | Nordlof | 226/162 |
| 4,051,987 | 10/1977 | Scribner | 226/162 |

*Primary Examiner*—H. Grant Skaggs

*Attorney, Agent, or Firm*—Cushman, Darby & Cushman

[57] ABSTRACT

A press-feed unit is operative to feed a length of stock material to a press. The unit comprises a body for fixing adjacent the press and a transport section reciprocable relative to the body by a pneumatic piston and cylinder assembly, the stock being clamped to the transport section during forward feed strokes of the latter. The unit further comprises a control valve, and a transport feed valve which is controlled by a pilot pressure signal from the control valve and operable to feed the transport cylinder. A pilot signal connection is provided which can be blanked off to enable the unit to operate independently, or connected through a pilot pressure pipe to a basically similar unit to provide a duplex arrangement of two units, one of which is directly controlled in dependence on press ram position and provides a pilot signal through said pipe to operate the transport feed valve of the other unit.

8 Claims, 9 Drawing Figures

PRESS-FEED UNITS

BACKGROUND OF THE INVENTION (a) Field of the Invention

This invention relates to a press-feed units which operate to feed a length of stock material, most commonly strip material, to a press in synchronism with press operation. It is particularly concerned with such units of the type having a body adapted for fixing adjacent the press and a transport section reciprocable relative to the body by a pneumatic piston and cylinder assembly, during guided reciprocation the stock being clamped to the transport section during the forward feed strokes of the latter.

(b) Description of the Prior Art

With present units of the foregoing type, if multiple duplex or double-acting arrangements are required they employ entirely different units and/or complicated synchronising control means. The main object of the invention is to overcome these disadvantages, enabling a whole family of feed units to be assembled from basic main sub-assemblies common to several units. A further object is to provide a unit which is usable in a multiple arrangement capable of operating at unusually high speed while being no more, or in some cases less, complicated than existing multiple arrangements.

It is common practice to couple two units together, to provide a right-hand master unit and a left-hand slave unit which operate in tandem while respectively gripping the opposite side edges of wide strip or sheet material. In the past the control valve section of the master unit has been operated in dependence on press movement, as for a single unit, and the controlled pressure transport cylinder feed has been split between the master and slave units. Accurate splitting of this pressure feed is necessary for satisfactory duplex operation of the units, so that setting up is a difficult and complex procedure.

Instead of two side-by-side units operating in tandem, to cooperate in feeding strip stock simultaneously, they may operate out of phase to feed the stock alternately. Such a double-acting arrangement can theoretically feed the stock at a speed twice that of a single unit, but in the past very complex press/feed control arrangements have been necessary to synchronise the units.

SUMMARY OF THE INVENTION

According to the invention a press feed unit comprises an assembly including a body adapted for fixing adjacent a press, a transport section reciprocable relative to the body by a pneumatic piston and cylinder assembly, a control valve, a transport feed valve for control by a pilot pressure signal from the control valve and operable to feed the transport cylinder and at least one pilot signal connection which can be blanked off to enable the unit to operate independently as a single press feed unit or connected through a pilot pressure pipe to a basically similar unit to provide a duplex arrangement of two units, whereby one of the units can be directly controlled in dependence on press ram position and provide a pilot signal through said pipe to operate the transport feed valve of the other unit.

Thus in a duplex arrangement the control valve of the master unit is operated mechanically in dependence upon the position of the press ram and the pilot connection provides the pilot signal to operate the transport feed valve of the slave unit, thereby to provide simultaneous and reliable in phase operation of the master and slave units without the need for accurate splitting of a pressure feed. The control valve may be removable for replacement by a blanking plate to provide the slave unit, and it will be appreciated that either the left-hand or the right-hand unit may retain the control valve and thus become the master unit as is convenient.

The normal fixed and feed clamps of the unit may be double-acting for rapid and reliable operation. In this case said pilot signal connection may be one of two such connections, to allow the units to be interconnected through two pipes providing alternative signals to control the double-acting clamps of the slave unit of a duplex arrangement.

To enable the same basic assembly of unit to be used in a double-acting arrangement, the assembly may be adapted for the fitting of an additional double-acting control valve with the normal control valve adapted for pilot operation. The terms "master" and "slave" are conveniently replaced by "left-hand" and "right-hand" in now referring to the two units since each must be fitted with a normal control valve which is capable of pilot operation. In this case one of the units is fitted with the additional control valve which is controlled mechanically in dependence on press ram position and which functions to provide separate pilot pressure signals, respectively on alternate press ram strokes, for the operation in turn of the normal control valves of the two units. Thus the double-acting additional valve is connected directly to th pilot connection of each normal control valve, on one side to that of the unit to which it is added by a flexible pipe to the control valve of the other unit.

In a double-acting arrangement of two units the two feed clamps are alternatively operable, and the usual fixed clamps are omitted and may be replaced by either the additional control valve or a blanking plate.

Thus, the invention readily provides a press feed unit which can be used with a basically similar unit in either a duplex or double-acting arrangement with the two units interconnected by a pilot pressure pipe, for double-acting operation an additional main control valve being fitted to either the left-hand or the right-hand unit.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

Figure 1:
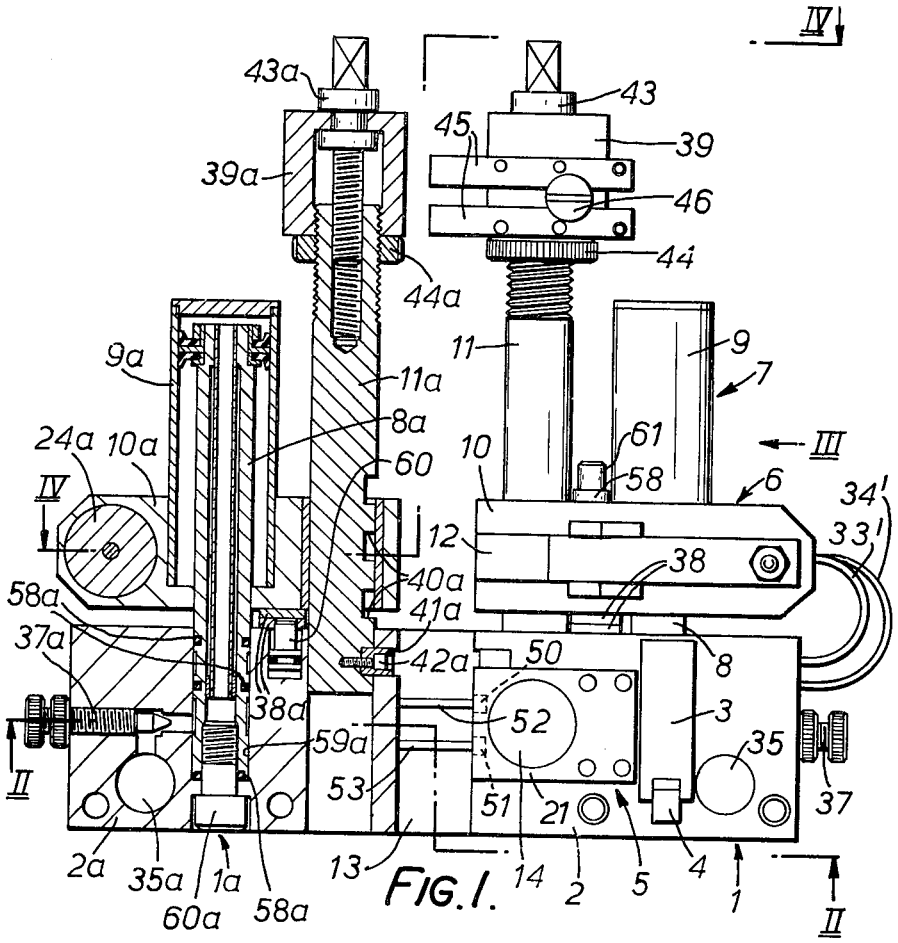
FIG. 1 illustrates in plan view a basic right-hand unit in accordance with the invention and, partly in section, the addition of a basically similar corresponding left-hand unit to provide a duplex arrangement.

The basic right-hand 1, i.e. a unit which feeds stock material (not shown) along the right-hand side of the unit when viewed in the feed direction, is shown at the bottom of FIG. 1 and has a main body comprising a rectangular base block 2 for fixing immediately adjacent the press to be fed. A control valve block 3 is detachably mounted on top of the block 2 and has at one side a projecting actuating member in the form of a pivotal rocker 4 which is displaced mechanically, to synchronise the feed with the press operation by a cam (not shown), fitted to the ram of the press. Also mounted on the block 2 is a fixed stock clamp 5 which operates to clamp the stock during each return stroke of a transport section 6 of the unit.

The transport section 6 is pneumatically actuated by a piston and cylinder assembly 7, the piston rod 8 of which is fixed in and projects from the block 2 whereas the cylinder 9 of this assembly is detachably fixed to a feed slide 10. The slide 10 is guided on a fixed guide rod 11 which projects rigidly from the block 2 parallel to the piston rod 8. While the cylinder 9 is of light-weight construction, being thin-walled and of light alloy to provide low inertia for the transport section 6 and thus enable exceptionally high-speed operation to be possible, the steel piston rod 8 is sufficiently massive and rigid to function also as a second guide for the slide 10, thereby obviating the second guide rod which has normally been provided in prior units. A feed clamp 12 mounted on the slide 10 clamps the stock during each feed stroke, so that the stock advances with the slide 10 during which time the clamp 5 is released.

For duplex operation with a slave unit for which the right-hand unit 1 acts as a master, a slave unit 1*a* shown at the top of FIG. 1 is used which is basically of identical form apart from being appropriately left-handed. In the drawings such an arrangement is illustrated with the body block 2*a* of the slave unit 1*a* and the block 2 of the master unit 1 mounted on a common base plate 13, corresponding parts of the slave unit utilising the same reference numerals as the master unit but distinguished by the suffix a. Some internal detail of the units is shown only in the sectional views of the slave unit, and although this description will now be continued with reference to the master unit 1 alone some details thereof referred to are shown only in the sectional views of the slave unit and identified by the plain reference numerals used in the text but with the suffix a.

Figure 2:
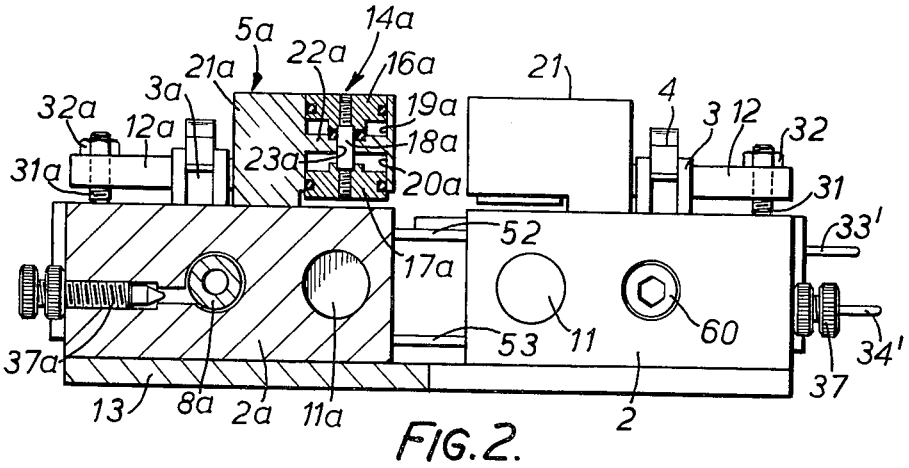
FIG. 2 is an end view, in the return stroke direction, corresponding to FIG. 1.
Figure 3:
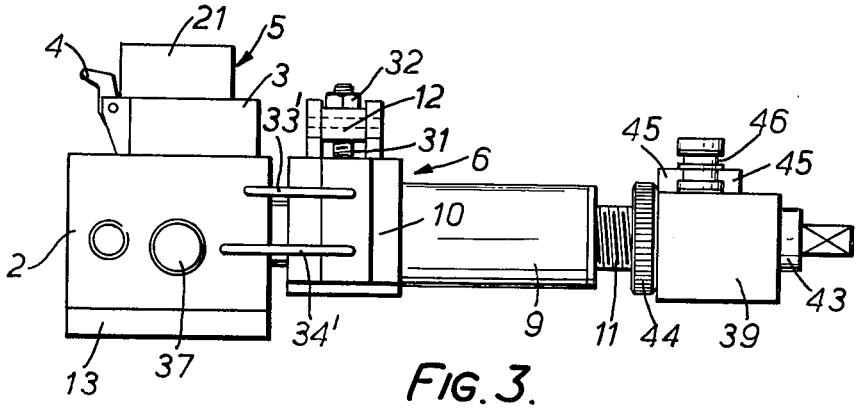
FIG. 3 is a side view of the unit in the direction of the arrow III in FIG. 1.
Figure 4:
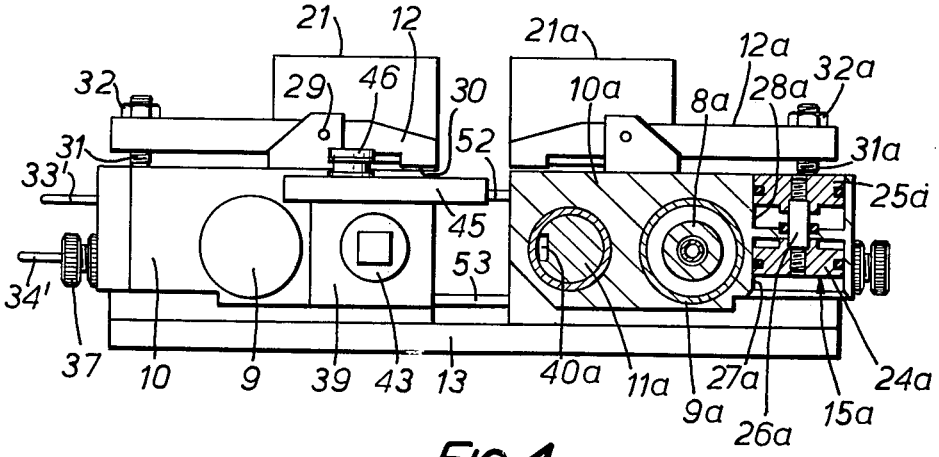
FIG.4 is an opposite end view, partly sectioned on the line IV—IV in FIG. 1.

The clamps 5 and 12 are respectively operated by double-acting piston assemblies 14 and 15. The assembly 14 comprises two spaced pistons 16 and 17 mounted on a common piston rod 18 and respectively slidable in aligned cylinders 19 and 20 in the body 21 of the fixed clamp 5. The cylinders 19 and 20 are separated by a wall 22 with a bore 23 through which the piston rod 18 slides and relative to which it is sealed. The actuating piston arrangement for the feed clamp 12 is identical with that of the fixed clamp 5. Thus the assembly 15 comprises pistons 24 and 25 mounted on a common piston rod 26 and respectively slidable in aligned cylinders 27 and 28 in the slide 10. As can be seen clearly from FIG. 2, the piston 17 of the assembly 14 directly engages the strip material to clamp the latter against the upper face of the base block 2 during return strokes of the transport section 6. The clamp 12 comprises a lever which rocks about a pivot 29 and has an end clamping face 30 which engages the stock and clamps it against the upper face of the slide 10 during each feed stroke. To actuate this clamp the piston 25 of the assembly 15 engages a screw 31 which projects from the clamp lever 12 adjacent the other end thereof, this screw being locked in adjusted position by a lock nut 32.

Figure 5:
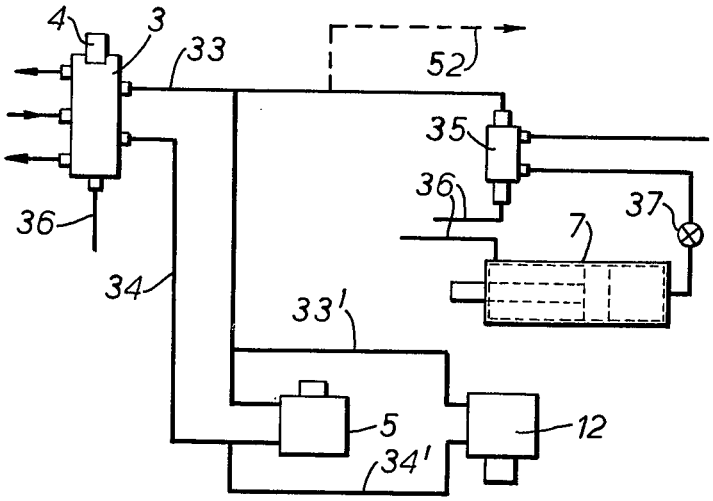
FIG. 5 is a control circuit diagram relating to the right-hand unit in FIG. 1.

Clamps 5 and 12 are alternately actuated under common control by the five-port control valve housed in the block 3, as shown in the circuit diagram of FIG. 5, through connections 33 and 34. Energisation of connection 33 on actuation of the main control valve operates the fixed stop clamp 5 and frees the feed clamp 12, with connection 34 connected to exhaust, and vice versa. The conncetion 33 also provides a pilot connection for a three-port feed control valve 35 mounted within the base block 2, and this valve 35 actuates the piston and cylinder assembly 7 to produce feed strokes of the transport section 6. The main control valve, the feed control valve and the feed piston have connections 36 to the supply pressure, thereby biasing these components with an air spring return. The various pneumatic connections are provided by drillings within the base block 2 and feed slide 10, the interconnection of these two components for operation of the feed clamp 12 being through flexible pipes 33′ and 34′. The pneumatic interconnection of the clamps 5 and 12, with operation through common connections 33 and 34, ensures that the clamps must operate alternately and mutually exclusively under the control of the main control valve.

The general operation of the unit is as follows. When the unit is at rest, i.e. the press ram is at the top of its stroke, the transport section 6 is at rest adjacent the body block 2 as shown in the drawings, the feed clamp 12 is operative to hold the stock and the stock clamp 5 is free. At the mid-point of the downward stroke of the press said cam actuates the valve rocker 4 to operate the main control valve which energises the connection 33 and exhausts the connection 34 to reverse the stock clamp 5 and the feed clamp 12, and to provide a pilot operating signal for the feed control valve 35. Operation of the valve 35 causes the transport section 6 to reverse and move back away from the block 2. This valve condition is maintained until the press ram has returned to the midway position on its upward return stroke, when the rocker 4 is released by said cam. This exhausts the connection 33 and energises the connection 34, with consequential change-over of the valve 35. Thus the two clamps are reversed, the stock again being gripped by the feed clamp 12, and a forward feed stroke of the transport section 6 commences.

An adjustable needle valve 37 at the rear of the block 2 is connected in series with the feed control valve 35 and the hollow piston rod 8 through which the cylinder 9 is pressurised, and hence provides for speed adjustment. The block 2 and the slide 10 carry stop plates 38 which engage to limit movement of the slide in the feed stroke direction, and the guide rod 11 is fitted with an end stop block 39 and is slidably adjustable in the block 2 for stepwise adjustment of the stroke length. The rod has four flat location recesses 40, and it is located in adjusted position by a key 41 which engages a selected one of the recesses 40 and is locked in position by a screw 42. The stop block 39 telescopically engages over the end of the rod 11 and is non-rotatable thereon, being adjusted to adjust the end of the return stroke by a screw 43 threaded into the end of the rod 11. It is locked in adjusted position by a lock nut 44, which is the element actually engaged by a stop plate 58 on the slide 10 to limit slide movement. Mounted on the stop block 39 are two spaced parallel support bars 45 on which the stock being fed is supported, and an edge guide for the stock is adjustably fixed between the bars 45.

Figure 9:
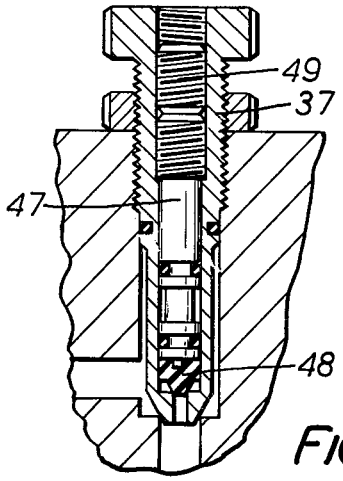
FIG. 9 is a cross-sectional detail view illustrating a modification.

On setting up of the unit the speed control valve 37 is adjusted so that the slide 10 just lightly kisses the end stops. As a modification, if it is found that the slide 10 strikes one of the end stops with undue force, an adjustable one-way by-pass valve 47 may be fitted within the needle valve 37 as shown in FIG. 9. This valve has a valve disc 48 which can be turned over to change the by-pass direction, and the valve 47 is adjusted so that both end stops 38 and 39 are contacted with equal force. Once adjusted for a particular unit the setting of this valve 47 remains constant for different transport speeds, and an end bore 49 in the valve 37 through which screwdriver adjustment of the valve is effected can be sealed after adjustment on assembly. The required by-pass direction is determined experimentally as which end stop would be struck more violently, without the one-way by-pass action, cannot be forecast in advance.

For duplex operation with a slave unit for which the right-hand unit 1 acts as master, the slave unit 1*a* is used and which as already mentioned is of basically identical form. No modification of the master unit 1 is required and blanking plugs at 50 and 51 are removed for interconnection of the two units by two small bore pilot signal pipes 52 and 53 which respectively interconnect with the connections 33*a* and 34*a* of the slave unit 1*a*. The slave unit 1*a* is of identical but "handed" construction, and during slave operation the valve 3 is replaced by a blanking plate.

With this simple duplex arrangement the two units operate in tanden under common control from the main valve 3 of the master unit 1, which acts as the control valve for each unit. Thus wide stock can be fed gripped at both side edges simultaneously by the two units. As the interconnection of the units is really only by the pilot signal pipe 52, the unit 1*a* having effectively a separate pneumatic supply with its own by-pass speed control valve 37*a*, rapid signal transfer is achieved and delay in slave operation is minimal. Thus the duplex arrangement operates with greater accuracy at a higher speed than is normally achieved with such arrangements of press feed units.

Figure 6:
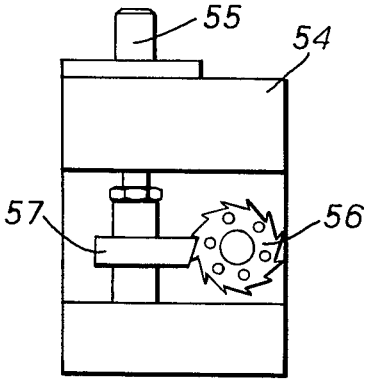
FIGS. 6 and 7 are respectively end and side views of a control valve block for adapting the basic unit to double-acting operation.
Figure 7:
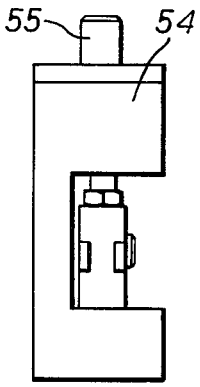
Figure 8:
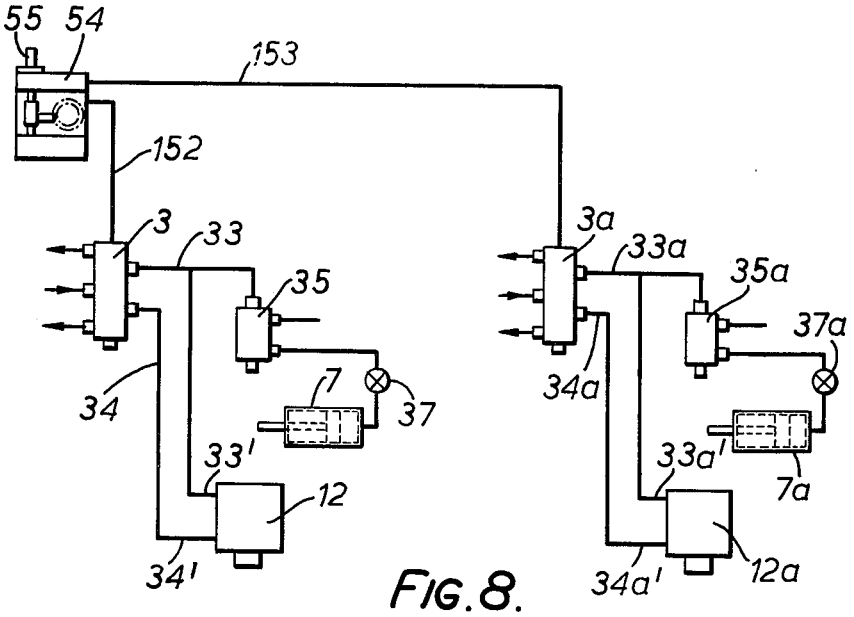
FIG. 8 is a control circuit diagram relating to double-acting operation.

For double-acting operation, i.e. with both units 1 and 1*a* operating alternately to feed the stock, the blanking plugs 50, 51 and 50*a*, 51*a* are left in position. However, in this case the fixed stock clamps such as 5 are removed, the block 21*a* being replaced by a blanking plate, and the block 21 of the unit 1 replaced by a twin-valve block 54 which, as illustrated in FIGS. 6 and 7, has a top operating plunger 55 which is now actuated by the press cam. Movement of the plunger 55 steps on a ratchet cam 56 which operates alternately two three-way valves (not shown) in the block 3. One of these valves provides pilot pressure through an external flexible pipe 152 for operating the control valve 3 of the unit 1 to which the valve block 54 is fitted and the other separately provides pilot pressure, through an external flexible pipe 153, for the control valve 3*a* of the unit 1*a* as shown in the circuit diagram of FIG. 8.

The detailed operation of this double-acting arrangement is as follows. As the press ram descends to the mid-point the cam strikes the plunger 55 which carries a projecting spring-loaded ratchet pawl 57. The tapered bias of the pawl 57 is such that the ratchet cam 56 is not advanced as the plunger 55 is depressed during continued ram descent. Thus the two transport sections do not move until the press ram commences its upward return stroke and the press punch is clearing the workpiece. As the ram ascends the cam 56 turns to free one previously operated control valve (3 or 3*a*) and to operate the other and previously free control valve (3*a* or 3). As the feed clamps are operated at the same time as pilot operation of the control valves 3 and 3*a*, respectively, the clamps will always reverse before a transport section moves.

Thus the units 1 and 1*a* operate alternately, a feed stroke of one occurring during a return stroke of the other. The result is that the stroke is fed at twice the speed obtainable with a single unit, and without the complicated external control system and synchronisation problems that such an arrangement has previously required. The units are merely interconnected by the plain flexible pipes 152 and 153, and the clamp block 21 replaced by the double-valve block 54.

Although mechanical synchronising valve operation has been described, with the main control valves 3 and 3*a* plunge operated by a press-plunger cam, it will be appreciated that control may alternatively be by a remote-controlled pneumatic signal. This signal may, for example, be obtained from a proprietary valve operated by the ram of the press. In the arrangements described the length of stroke may be adjusted within the capacity of the cylinder and piston rod fitted. Further adjustment is possible to any reasonable length of stroke by fitting longer cylinders and piston rods to the same body assemblies. To facilitate this the cylinder 7 is screw-threaded into the slide 10, for easy removal and replacement, and the piston rod 8 with its seals 58 fits into a plain bore 59 in the block 2 in which it is retained by a screw 60. The guide rod 11 is also easily replaced when a longer rod is necessary.

Two cushion pistons 60, 61 respectively mounted in the block 2 and the slide 10 respectively project through the slide stop plates 38 and 58. These pistons are supplied with pressure air through small orifices, for example of 0.010 inch diameter, from the lines 33 and 34. Thus these pistons act alternately to damp the ends of the slide stroke, and by choice of appropriate size orifices an automatically adjusting damper action can be obtained if on short stroke lengths the orifices do not allow the pistons to extend fully whereas on long strokes they do extend fully before being engaged by the slide 10 and the lock nut 44 respectively.

I claim:

1. A press-feed unit comprising an assembly including a body adapted for fixing adjacent a press, a transport section reciprocable relative to the body, a pneumatic piston and cylinder assembly for reciprocating the transport section, a control valve operable in dependence on press ram position, a transport feed valve for control by a pilot pressure signal from the control valve and operable to feed the transport cylinder of said assembly, and at least one pilot signal connection at which said pilot pressure signal is available and which is readily accessible and connectable to provide a pilot pressure operating signal, when so desired, for the control of a separate unit.

2. A press-feed unit according to claim 1, wherein said control valve is operable mechanically in dependence on press ram position and is also operable by a pneumatic control signal.

3. A unit according to claim 1, further comprising a fixed stock clamp mounted on said body and a feed stock clamp mounted on said transport section, said clamps being alternately operable under the common control of said pilot pressure signal and a further pilot pressure signal, and wherein said pilot signal connection is one of two such connections at the other of which said further pilot pressure signal is available.

4. A press-feed unit according to claim 1, wherein said control valve is embodied in a detachable valve block, and a blanking plate is provided to replace the valve block when the latter is attached, the arrangement being such that with the valve block replaced by the blanking plate the unit is operable at least in part under the control of a pneumatic signal applied to said pilot signal connection.

5. A combination of two press-feed units of similar basic construction and pneumatically interconnected to provide a duplex-operating arrangement: each said unit comprising a body for fixing adjacent a press, a transport section reciprocable relative to the body, a pneumatic piston and cylinder assembly for reciprocating the transport section, a feed stock clamp on said transport section, a transport feed valve operable to feed the cylinder of said piston and cylinder assembly, a fixed stock clamp mounted on the body, said stock clamps operating alternately under the common control of two respective pilot control signals one of which commonly operates said transport feed valve, an externally accessible pilot signal connection at which said one pilot control signal is available, and a pilot pressure pipe interconnecting the respective signal connections of the two units; one of said units further comprising a control valve operable in dependence on press ram position, said control valve providing said two pilot control signals at said one unit with said one pilot control signal transferred to the other of the two units through said pilot pressure pipe whereby said other unit operates as a slave unit.

6. A combination of two press-feed units of similar basic construction and pneumatically interconnected to provide a double-acting arrangement with the units operating out of phase: each unit comprising a body for fixing adjacent a press, a pneumatically-operated secondary control valve, a transport section reciprocable relative to the body, a pneumatic piston and cylinder assembly for reciprocating the transport section, a feed stock clamp on said transport section, a transport feed valve operable to feed the cylinder of said assembly, said feed stock clamp operating under the control of at least one pilot control signal from said control valve and which also operates said transport feed valve; one of said units further comprising a double-acting primary control valve operable in dependence on press ram position, said primary control valve having two alternatively energised outputs one of which supplies a control signal for the secondary control valve of said one unit; and a pilot pressure pipe which externally interconnects the other of said primary control valve outputs with the secondary control valve of the other of said units, whereby said primary control valve alternately controls the secondary control valves of the two units.

7. A combination according the claim 6, wherein the double-acting valve is mechanically operated for operation in dependence on the position of the press ram.

8. A combination according to claim 6, wherein said double-acting control valve comprises a block attachable to the body of the assembly, an operating plunger which projects from the block being associated with a pawl which drives a ratchet cam by which the double-acting valve is actuated to provide alternative output signals on successive strokes of the press ram.

* * * * *